US006637775B1

(12) United States Patent
Bernier et al.

(10) Patent No.: US 6,637,775 B1
(45) Date of Patent: Oct. 28, 2003

(54) TWO-PLY LABEL FOR PHARMACEUTICAL PRODUCTS

(75) Inventors: Daniel Bernier, Boisbriand (CA); Detley Bilo, Mississauga (CA); Ted Ramsay, Burlington (CA)

(73) Assignee: Cameo Crafts Graphic Industries Limited, Montreal (CA)

( * ) Notice: Subject to any disclaimer, the term of this patent is extended or adjusted under 35 U.S.C. 154(b) by 0 days.

(21) Appl. No.: 10/091,550

(22) Filed: Mar. 7, 2002

(51) Int. Cl.[7] ..... B42D 15/00
(52) U.S. Cl. ..... 283/94
(58) Field of Search ..... 283/79, 80, 81, 283/94, 98, 99, 100, 101, 105, 117; 428/40.1; 40/299, 310

(56) References Cited

U.S. PATENT DOCUMENTS 5,056,827 A 10/1991 Sasso
5,342,093 A * 8/1994 Weernik ..... 283/81
5,389,415 A * 2/1995 Kaufmann ..... 283/81
5,439,721 A * 8/1995 Pedroli et al. ..... 283/81
5,958,536 A 9/1999 Gelsinger et al.
6,159,568 A * 12/2000 Freedman et al. ..... 428/36.91

FOREIGN PATENT DOCUMENTS

CA 2297193 7/2000

* cited by examiner

*Primary Examiner*—Willmon Fridie, Jr.

(57) ABSTRACT

A two-ply label adapted to be adhered to an object, such as a pharmaceutical bottle, comprises a top ply having a front and rear printable surface and a bottom ply having a front printable surface and a rear surface having permanent adhesive thereon to adhere the label to the object. The top ply and the bottom ply are engaged such that the rear printable surface of the top ply and the front printable surface of the bottom ply are immediately superimposed. The rear printable surface of the top ply has a deadened adhesive thereon to permit the top ply to be repeatedly removably adhered to the bottom ply. The front printable surface of the bottom ply can also include an identification bar code, in which case the top ply has a corresponding cut-out therein to permit the bar code to be visible.

33 Claims, 1 Drawing Sheet

TWO-PLY LABEL FOR PHARMACEUTICAL PRODUCTS

TECHNICAL FIELD

The present invention relates to labels, and more particularly, to a two-ply label for pharmaceutical products having printing on three surfaces and a resealable top panel.

BACKGROUND OF THE INVENTION

As regulation of the pharmaceutical industry continues to increase, more and more information is required to be prominently displayed for consumers on the pharmaceutical product packaging or containers. Many pharmaceutical products also comprise a plurality of ingredients, all of which must be indicated on the product containers. While over-the-counter products sold in boxed packaging often have ample space for all the required consumer information, pharmaceutical products requiring physician prescriptions are sold by pharmacists in pill containers to which identification labels are affixed.

The significant amount of information required to be included on these pharmaceutical bottle labels poses considerable problems when traditional labels are used. Labels are either required to be very large in order to be able to contain all the required identification information, or the information is minutely printed to ensure it fits on the label. As well as the slightly increased cost of printing larger labels, the use of a larger container simply to be able to accommodate the increased label size would become necessary.

As a result, labels having more than one printed surface are becoming increasingly common. This permits a significant amount of information to be accommodated on the pharmaceutical bottle label, with legible sized printing and without resulting in an extremely crowded appearance.

U.S. Pat. No. 5,056,827 issued Oct. 15, 1991 to Sasso, for example, discloses a pharmaceutical label having a printed front and back side. Each end of the label is permanently adhered to the pharmaceutical bottle, and a central double-sided printed portion of the label is attached between the two glued ends. The printed underside of the label can be accessed by tearing away a perforated strip separating the central printed portion from one of the glued ends.

Canadian Patent Application 2,297,193, laid open Jul. 27, 2000, similarly discloses a label for a pharmaceutical bottle having a double sided printed section which can be peeled away from the permanently adhered end sections. However, after reading the information located on the reverse side of the printed section of the label, this section can then be resealed to its original position on the bottle. Minute spots of adhesive on the rear of the printed label section permit the peeled away section to be re-fixed in place.

Several problems with these labels nevertheless remain. The quantity of information now required has become too much to fit in a visibly pleasing way even on two sides of a standard sized label. Without increasing the size of the label, smaller printing is the only other solution at present. Another disadvantage of the resealable label of Canadian Patent Application 2,297,193 remains in that the small spots of adhesive quickly lose their adhesive properties once the label has been peeled back and replaced several times.

SUMMARY OF THE INVENTION

It is an object of the present invention to provide an improved label for pharmaceutical bottles.

It is another object of the present invention to provide a self-adhesive two-ply label.

It is another object of the present invention to provide a resealable label that permits the label to be peeled back and re-adhered many times.

It is a further object of the present invention to provide a two-ply label having printing on three sides of the label.

Therefore, according the present invention, there is provided a two-ply label adapted to be adhered to an object, said label comprising: a top and a bottom ply; said top ply having a front and rear printable surface, and said rear printable surface having deadened permanent adhesive thereon; said bottom ply having a front printable surface and a rear surface having permanent adhesive thereon, adapted to adhere said label to an object; and said rear printable surface of said top ply being immediately superimposed on said front printable surface of said bottom ply.

There is also provided a label adapted to be adhered to an object, said label comprising: a top and a bottom ply; said top ply at least partially superimposed on said bottom ply, and having a front and rear printable surface; said top ply being removably adhered to said bottom ply; and said bottom ply being adapted to be permanently adhered to an object.

According to the present invention, there is additionally provided a two ply label adapted to be adhered to an object, said label comprising: a top and bottom ply, hinged together along a common edge; said top ply having a front and rear printable surface; said bottom ply having a front printable surface and a rear surface having permanent adhesive thereon, adapted to adhere said label to an object; and said rear printable surface of said top ply being immediately superimposed on said front printable surface of said bottom ply.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
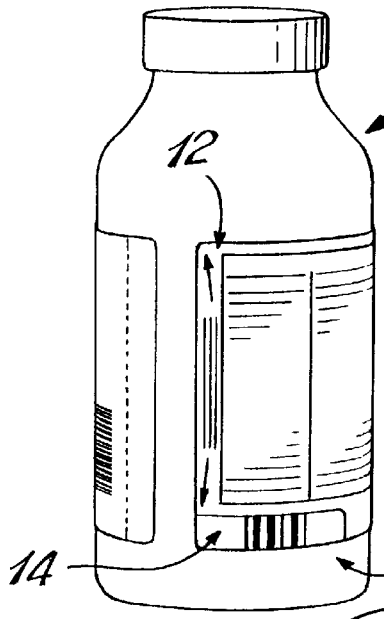
FIG. 1 is a perspective view of a two-ply label on a pharmaceutical bottle according to the present invention.

Referring to FIG. 1, a two-ply self-adhesive label 10 for pharmaceutical bottles or other similar containers 11 is shown. The two-ply label 10 generally comprises a bottom ply 14 and a top ply 12 hinged along edge 40.

Figure 2:
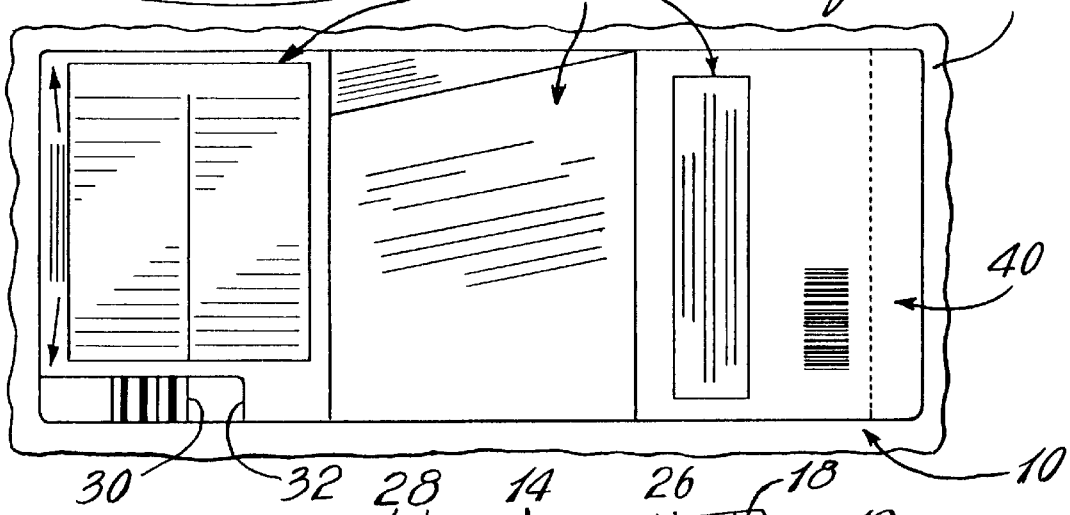
FIG. 2 is a top elevation view of the two-ply label shown in FIG. 1.
Figure 3:
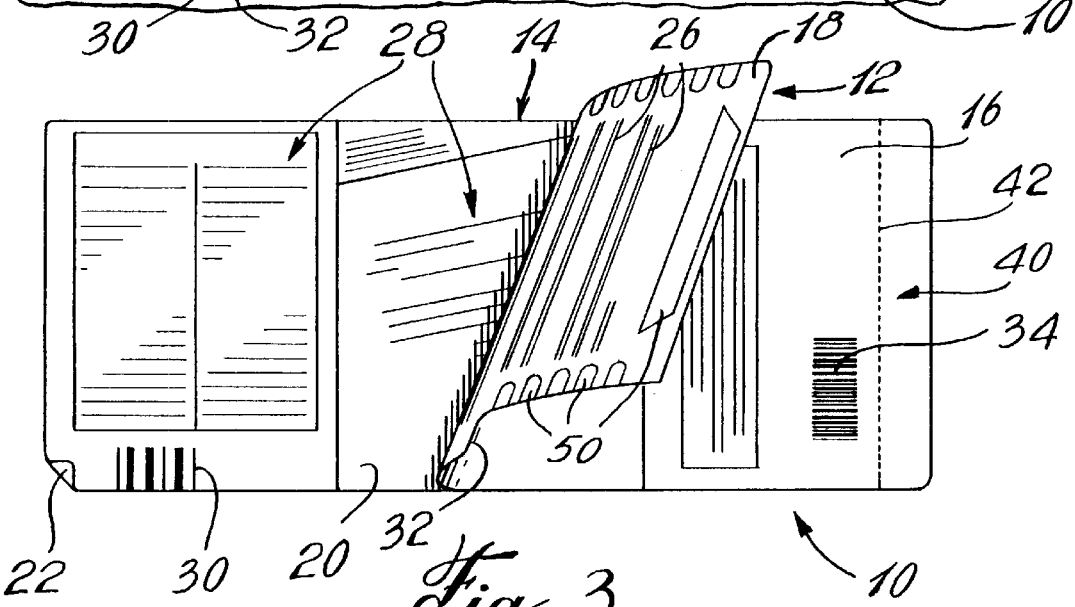
FIG. 3 is a top elevation view of the two-ply label shown in FIG. 1, having the top ply partially peeled back.

Referring now to the label 10 shown in more detail in FIGS. 2 and 3, both the front surface 16 and the rear surface 18 of the top ply 12 can be printed on. The bottom ply 14 comprises a front surface 20 having printing thereon, and a rear surface 22 which has a permanent adhesive applied thereon.

Indicia 24 on the front surface 16 of the top ply 12 of the label generally comprises, in the case of a pharmaceutical bottle application, such information as the drug trade name, warning labels, and other miscellaneous drug information. The two plies of the label provide between them a total of three printable surfaces, namely, front surface 16 and rear surface 18 of the top ply 12 and the front surface 20 of the bottom ply 14. This permits a large amount of printable surface area relative to the overall size of the label. Therefore, the label provides ample space for detailed medical information content, and a full list of pharmaceutical ingredients. This also permits the information to be clearly laid-out and displayed in a much more reasonably sized font, creating a significantly more legible overall appearance.

Indicia 26 on the rear surface 18 of the top ply can include such things as lengthy lists of ingredients or other warning labels.

The pharma-code 30, which is printed on the front surface 20 of the bottom ply 14, is generally a coloured identification bar code. The corresponding cutout 32 in the top ply 12 provides visibility of the bar code even when the top ply 12 is superimposed on and removably adhered to the bottom ply 14. The pharma-code 30 serves to ensure that the top and bottom plies of the two-ply label 10 correctly correspond such that no possible errors in the display of the medical information can occur. Both the pharma-code 30 and a traditional bar code 34 on the front surface 16 of the top ply 12 can be scanned using scanning systems well known in the art, to ensure that the correct top and bottom plies are matched in the label production process.

The top ply is removably adhered to the bottom ply such that it can be repeatedly peeled back to expose the indicia and then re-adhered. This is achieved by deadening most of the adhesive on the printed center portion of the rear surface 18. Small spots of non-deadened adhesive 50 are left along the edges of the rear surface 18 of the top ply 12. The rear surface 22 of the bottom ply 14 is coated with a permanent adhesive. This ensures that once the label is applied to a pharmaceutical bottle or other container, it cannot be tampered with or removed.

The top and bottom plies of the two-ply label are engaged along a permanently adhered edge 40. This ensures that the top ply can be prevented from being completely removed from the pharmaceutical bottle onto which the label is applied, if necessary. In other cases, it is desirable to permit the complete removal of the top ply 12 of the two-ply label. For example, the pharmacist can easily remove the top ply of the two-ply label and adhere it directly to documents in the patient's file. For such applications, the top ply is provided with a perforated line 42, adjacent the edge permanently adhered to the bottom ply. This permits the top ply 12 to be easily peeled back and torn away from the bottom ply 14 along perforated line 42.

The material composition of the label elements and the adhesive type used can be chosen from a variety of materials and adhesives, providing they permit functionally equivalent results. The label is preferably made of a white, opaque, high gloss, coated litho product or polyolefin film, designed for general purpose permanent labelling applications. The permanent adhesive is preferably an acrylic based, rubber based, or solvent based elastomeric, which features good initial tack and ultimate adhesion to a wide variety of substrates. The release liner is preferably a semi-bleached, supercalendered, silicone coated, kraft backing paper or a silicone coated biaxially oriented polypropylene film, which features high internal strength, toughness, and tear resistance. The label materials used for the preferred embodiment are preferably chosen from the following: 56# Ultragloss with P902 adhesive and either the SCK 50# or Label-Mate® release liner, sold by Avery Dennison; 3.5 mil. Fasson® PRIMAX® with Fasson® P910 adhesive and 50# SCK release liner, sold by Avery Dennison; 65# White Gold® with MP710 adhesive and 3.2 mil. SCK 50# release liner; 37# Pharma Litho with 160P adhesive and KV50 release liner, sold by JAC Canada Inc.; 60# Cast Coated with 150P adhesive and KV50 release liner, sold by JAC Canada Inc.; and #60 Cast Coated with E117 adhesive and KV50 release liner.

Changes and modifications may be made by persons skilled in the art, without departing from the spirit and scope of the invention. The application of the invention is not limited to pharmaceutical bottle use, but labels according to the present invention can equally be used for identifying any other object requiring a label. Additionally, alternative label materials and adhesives can also be similarly used. The above description of the embodiment is for illustration of the invention only and is not intended to limit the scope of the invention, which is intended to be limited only by the scope of the appended claims.

What is claimed is:

1. A two-ply label adapted to be adhered to an object, said label comprising:

a top ply and a bottom ply;

said top ply having a front printable surface, a rear printable surface and a cut-out, said rear printable surface having adhesive thereon;

said bottom ply having a front printable surface including an identification bar code, and a rear surface having permanent adhesive thereon for adhering said label to an object;

said rear printable surface of said top ply being immediately superimposed on said front printable surface of said bottom ply, said cut-out of said top ply permitting said identification bar code to be visible when said top ply is removably adhered to said bottom ply.

2. A label adapted to be adhered to an object, said label comprising:

a top ply and a bottom ply;

said top ply being at least partially superimposed on said bottom ply, and having a front printable surface, a rear printable surface and a cut-out;

said top ply being removably adhered to said bottom ply; and said bottom ply having a front printable surface with an identification bar code printed thereon, and a rear surface having permanent adhesive thereon for permanently adhering to an object;

said cut-out permitting said identification bar code to be visible when said top ply is removably adhered to said bottom ply.

3. A two ply label adapted to be adhered to an object, said label comprising:

a top ply and a bottom ply, hinged together along a common edge;

said top ply having a front printable surface and a rear printable surface;

said bottom ply having a front printable surface having an identification bar code printed thereon, and a rear surface having permanent adhesive thereon for permanently adhering said label to an object; and said rear printable surface of said top ply being immediately superimposed on said front printable surface of said bottom ply;

said top ply comprising a cut-out permitting said identification bar code to be visible when said top ply is superimposed on said bottom ply.

4. A two-ply label adapted to be adhered to an object, said label comprising:

a) a top ply and a bottom ply;

b) said top ply having a removably adhesive portion that is adapted to be removably adhered to a portion of said bottom ply, said removably adhesive portion including a front printable surface, a rear printable surface and a cut-out portion;

c) said bottom ply having a front printable surface including an information element and a rear surface having permanent adhesive thereon for adhering said label to an object;

d) said cut out portion of said top ply permitting said information element of said bottom ply to be visible when said removably adhesive portion of said top ply is removably adhered to said bottom ply.

5. The label as defined in claim 4, wherein said label is a pharmaceutical label.

6. The label as defined in claim 5, wherein the object is a pharmaceutical container.

7. The label as defined in claim 4, wherein said top ply has an edge portion that is permanently adhered to a portion of said bottom ply.

8. The label as defined in claim 4, wherein said information element comprises an identification bar code.

9. The label as defined in claim 8, wherein said identification bar code can be used to ensure that said top and said bottom ply of said label correspond.

10. The label, as defined in claim 8, wherein said identification bar code is a pharma-code.

11. The label as defined in claim 4, wherein said rear printable surface has adhesive thereon.

12. The label as defined in claim 11, wherein at least some of said adhesive is deadened.

13. The label as defined in claim 12, wherein said removably adhesive portion of said top ply includes a peripheral edge along said rear printable surface, tacky adhesive being located along at least a portion of the peripheral edge.

14. A two-ply label adapted to be adhered to an object, said two-ply label comprising:

a) a top ply and a bottom ply;

b) said top ply having a removably adhesive portion that is adapted to be removably adhered to a portion of said bottom ply, said removably adhesive portion including a front printable surface and a rear printable surface;

c) said rear printable surface having:

i) an edge with tacky adhesive located along at least a portion of the edge; and ii) a region of deadened adhesive.

15. A label as defined in claim 14, wherein said rear printable surface includes a printed center portion, and wherein said region of deadened adhesive is located at said printed center portion.

16. The label as defined in claim 14, wherein said edge with tacky adhesive is a first edge portion, said rear printable surface including a second edge portion that is permanently adhered to a portion of said bottom ply.

17. The label as defined in claim 14, wherein said label is a pharmaceutical label.

18. The label as defined in claim 14, wherein the object is a pharmaceutical container.

19. The label as defined in claim 14, wherein said bottom ply has a front printable surface and a rear surface having permanent adhesive thereon for adhering said label to an object.

20. The label as defined in claim 19, wherein said front printable surface of said bottom ply comprises an identification bar code thereon.

21. The label as defined in claim 20, wherein said identification bar code is a pharma-code.

22. The label as defined in claim 20, wherein said removably adhesive portion of said top ply comprises a cut-out permitting said identification bar code to be visible when said removably adhesive portion of said top ply is removably adhered to said bottom ply.

23. The label as defined in claim 20, wherein said identification bar code can be used to ensure that said top and said bottom ply of said label correspond.

24. The label as defined in claim 14, wherein said deadened adhesive partially covers said rear printable surface of said top ply.

25. A two-ply label adapted to be adhered to an object, said label comprising:

a) a top ply and a bottom ply;

b) said top ply having:

i) an edge portion that is permanently adhered to a first portion of said bottom ply;

ii) a removably adhesive portion that is adapted to be removably adhered to a second portion of said bottom ply, said removably adhered portion including a front printable surface and a rear printable surface;

iii) wherein said top ply includes a perforated line between said edge portion and said removably adhesive portion such that said removably adhesive portion can be torn away from said bottom ply;

c) said bottom ply having a front printable surface, and a rear surface having permanent adhesive thereon for adhering said label to an object.

26. The label as defined in claim 25, wherein said label is a pharmaceutical label.

27. The label as defined in claim 26, wherein said rear printable surface has deadened adhesive thereon.

28. The label as defined in claim 25, wherein said object is a pharmaceutical container.

29. The label as defined in claim 25, wherein said front printable surface of said bottom ply comprises an identification bar code thereon.

30. The label as defined in claim 29, wherein said removably adhesive portion of said top ply comprises a cut-out permitting said identification bar code to be visible when said removably adhesive portion of said top ply is removably adhered to said bottom ply.

31. The label as defined in claim 30, wherein said identification bar code can be used to ensure that said top and said bottom ply of said label correspond.

32. The label as defined in claim 29, wherein said identification bar code is a pharma-code.

33. The label as defined in claim 25, wherein said rear printable surface of said removably adhesive portion of said top ply includes a peripheral edge, tacky adhesive being located along at least a portion of said peripheral edge of said rear printable surface.

* * * * *

UNITED STATES PATENT AND TRADEMARK OFFICE

CERTIFICATE OF CORRECTION

PATENT NO. : 6,637,775 B1
DATED : October 28, 2003
INVENTOR(S) : Daniel Bernier et al.

It is certified that error appears in the above-identified patent and that said Letters Patent is hereby corrected as shown below:

Title page,
Item [75], Inventors, second inventor should read -- Detlev, Bilo -- instead of "Detley, Bilo"

Signed and Sealed this

Twenty-sixth Day of October, 2004

JON W. DUDAS
*Director of the United States Patent and Trademark Office*